US006068520A

United States Patent [19]

Winings et al.

[11] Patent Number: 6,068,520

[45] Date of Patent: May 30, 2000

[54] LOW PROFILE DOUBLE DECK CONNECTOR WITH IMPROVED CROSS TALK ISOLATION

[75] Inventors: Clifford L. Winings, Etters; Robert E. Marshall, Elizabethtown; John M. Spickler, Marietta, all of Pa.

[73] Assignee: Berg Technology, Inc., Reno, Nev.

[21] Appl. No.: 08/816,846

[22] Filed: Mar. 13, 1997

[51] Int. Cl.[7] ..... H01R 24/00

[52] U.S. Cl. ..... 439/676; 439/941; 439/540.1; 439/701

[58] Field of Search ..... 439/676, 941, 439/541.5, 540.1, 701, 638

[56] References Cited

U.S. PATENT DOCUMENTS

| | | | |
|---|---|---|---|
| 4,103,985 | 8/1978 | Krolak et al. | 439/676 |
| 4,438,998 | 3/1984 | Myers | 339/154 A |
| 4,444,451 | 4/1984 | Myers | 339/154 A |
| 4,718,867 | 1/1988 | Seidel et al. | 439/609 |
| 4,772,224 | 9/1988 | Talend | 439/607 |
| 4,865,561 | 9/1989 | Collier et al. | 439/391 |
| 4,909,757 | 3/1990 | Reed | 439/532 |
| 5,092,785 | 3/1992 | Chen | 439/638 |
| 5,096,442 | 3/1992 | Arnett et al. | 439/676 |
| 5,131,866 | 7/1992 | Bodenweiser | 439/532 |
| 5,244,402 | 9/1993 | Pasterchick et al. | 439/217 |
| 5,308,260 | 5/1994 | Johnston et al. | 439/344 |
| 5,328,390 | 7/1994 | Johnston et al. | 439/638 |
| 5,378,172 | 1/1995 | Roberts | 439/607 |
| 5,425,172 | 6/1995 | Carswell et al. | 29/884 |
| 5,456,619 | 10/1995 | Belopolsky et al. | 439/676 |
| 5,496,195 | 3/1996 | Reed | 439/607 |
| 5,531,612 | 7/1996 | Goodall et al. | 439/541.5 |
| 5,562,507 | 10/1996 | Kan | 439/676 |
| 5,639,267 | 6/1997 | Loudermilk | 439/701 |
| 5,700,167 | 12/1997 | Pharney et al. | 439/676 |
| 5,773,763 | 6/1998 | Stachulla | 439/540.1 |

FOREIGN PATENT DOCUMENTS

| | | | |
|---|---|---|---|
| 0 080 772 A1 | 11/1982 | European Pat. Off. | H01R 13/26 |
| 0 634 817 A2 | 7/1994 | European Pat. Off. | H01R 23/02 |
| 0 929 131 A1 | 1/1999 | European Pat. Off. . | |
| 295 19 934 | 4/1996 | Germany . | |
| WO 97/10625 | 3/1997 | WIPO | H01R 13/514 |

*Primary Examiner*—Paula Bradley
*Assistant Examiner*—Tho D. Ta
*Attorney, Agent, or Firm*—Brian J. Hamilla; Daniel J. Long; M. Richard Page

[57] ABSTRACT

A stacked modular jack connector having low cross talk and low combined stack height is disclosed. Low stack height is achieved by disposing contact terminals for stacked pairs of receptacles in a single coplanar array of interleaved terminals. The arrays are located between the receptacles. One receptacle of each pair is laterally offset from the other. For Ethernet applications, cross talk is minimized by arranging first, second, third and sixth terminals of a ten terminal array into a contact group of the first receptacle and fifth, eighth, ninth and tenth terminals of the array into a contact group of the second receptacle. Circuit board space requirements are minimized by arranging the terminal tails of both groups of terminals in a single line.

62 Claims, 9 Drawing Sheets

LOW PROFILE DOUBLE DECK CONNECTOR WITH IMPROVED CROSS TALK ISOLATION

BACKGROUND OF THE INVENTION

1. Field of the Invention

This invention relates to connectors and particularly to low profile, multiple deck connectors with improved cross talk isolation.

2. Brief Description of Prior Developments

As a way of increasing the density of connectors, particularly telecommunications and data communications connectors, the concept of ganging receptacle connectors together in a common housing has been proposed. Placing rows of ganged connectors in stacked relationship has also been proposed. Such arrangements have been particularly prevalent in the telecommunications and data communications fields, in which FCC standardized RJ series modular jacks are commonly used.

As the number of I/O ports incorporated into each piece of equipment has increased, designers have sought ways to increase the number of ports present in a given space and minimize the amount of circuit board space required for the receptacles. One limiting factor on the effort to bring I/O ports closer together has been the need to maintain cross talk between ports (as well as within ports) at acceptable low levels, to maintain signal transmission integrity through the connector. Meeting cross talk specifications has been rendered more difficult by the ever increasing frequency of the transmitted signals, resulting especially from the drive toward higher and higher data transmission rates. To address cross talk considerations, the approaches have been to provide metal shields between the terminals of adjacent ports or maintain spatial distances between signal lines of the ports. This thwarts efforts to pack ports closer together. Other arrangements for minimizing cross talk utilize specially configured terminals that either follows circuitous routes through the connector or employ lengthy parallel paths to cancel cross talk. These latter mentioned efforts increase the complexity of the connector and raise its manufacturing cost.

SUMMARY OF THE INVENTION

The invention provides a low profile connector with high cross talk isolation by utilizing a connector housing with stacked openings or ports. A single array or comb of contacts is disposed between stacked openings. The openings are laterally offset, one with respect to the other. The offset allows interleaving of terminals of one of the ports with terminals of the other of the pair of stacked ports. The terminal interleaving and offset ports allow terminals to be positioned in such a way that potentially troublesome between-port cross talk is reduced to an acceptable level. The arrangement is especially useful for Ethernet systems.

The arrangement of terminals in a linear, substantially coplanar array facilitates arrangement of circuit substrate engaging tails of the terminals into a single line. This arrangement minimizes the space on the circuit substrate necessary for providing circuit connections.

DETAILED DESCRIPTION OF THE PREFERRED EMBODIMENTS

The invention is described in the context of a modular jack receptacle configured for standardized RJ 45 series eight position plugs. The invention is particularly useful for Ethernet systems wherein two pairs of terminal contacts, or four out of the eight positions, are utilized for signal transmission. However, the invention is considered to be useful for connectors of other styles and configurations.

Figure 1:
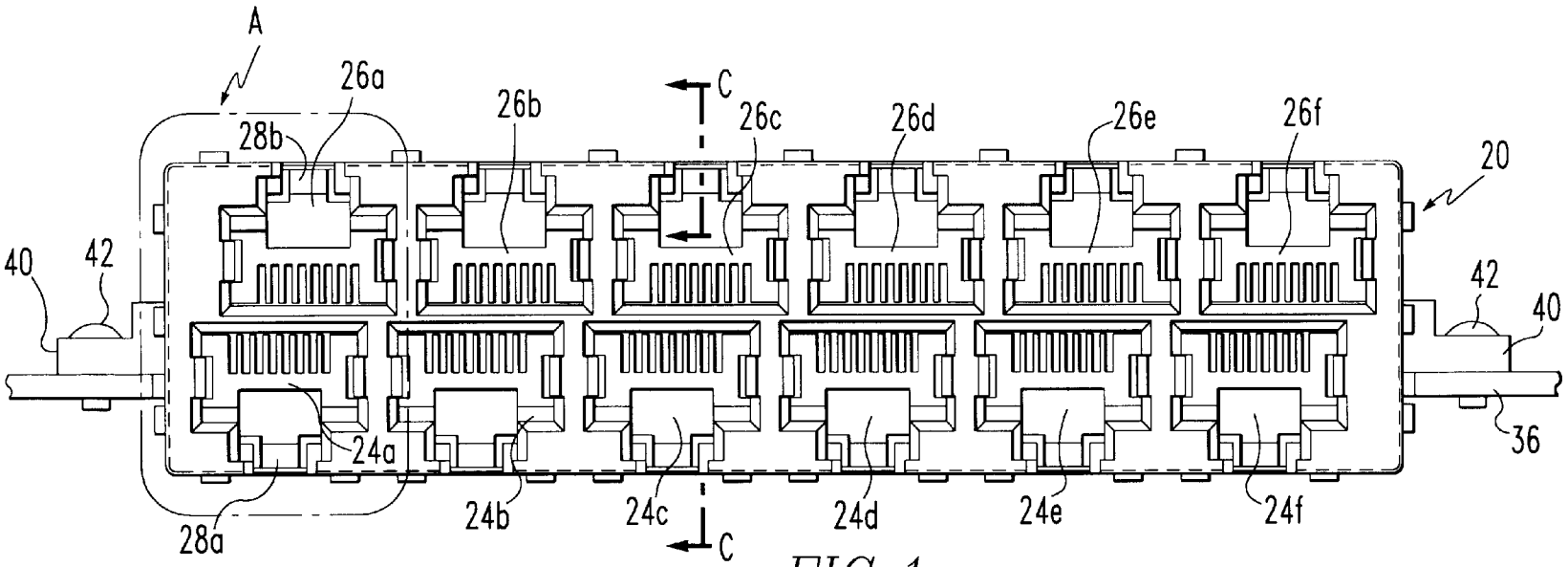
FIG. 1 is a front elevational view of a ganged modular jack receptacle embodying the invention.

As illustrated in FIG. 1, the illustrated embodiment of the connector 20 comprises a housing body 22, preferably formed of a molded insulating polymeric material. As illustrated, the body 22 includes a lower row of openings or ports 24*a*–24*f* shaped to receive a suitable mating connector such as an RJ 45 plug. A second or upper row of openings or ports 26*a*–26*f* are arranged in stacked relationship with respect to the lower openings. As is conventional, each of the openings includes a latch receiving recess 28*a*, 28*b* for receiving a latch associated with each plug.

Figure 2:
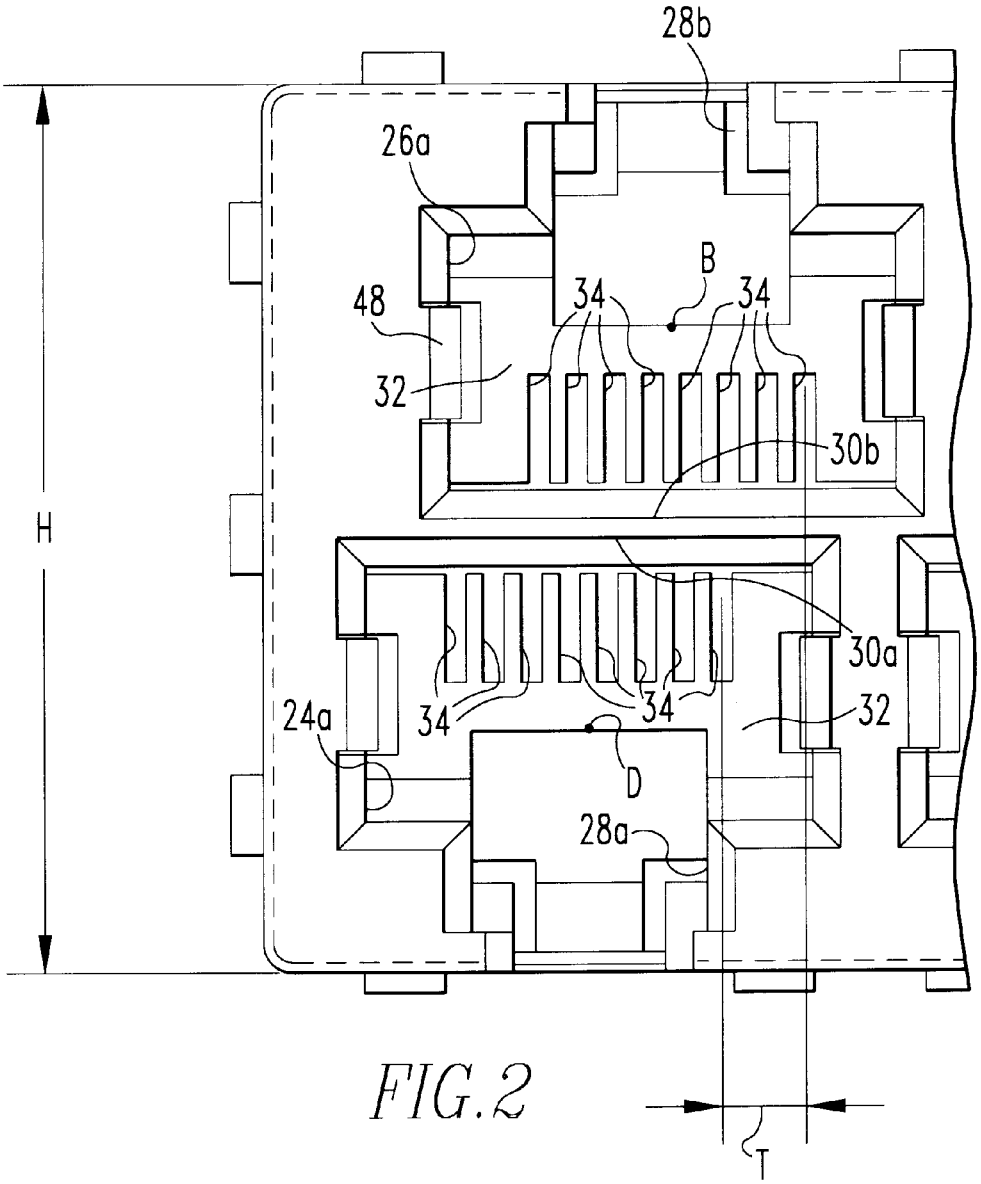
FIG. 2 is a fragmentary enlarged view of the portion of the jack of FIG. 1 within area A.

As shown in further detail in FIG. 2, the lower opening 24*a* and upper opening 26*a* are positioned with their bases 30*a*, 30*b* adjacent each other. In a preferred form, the openings 24*a* and 26*a* are positioned in a manner such that the overall height H of a two row connector is less than one inch and preferably is on the order of 0.87 inches. The manner in which this low height is achieved is explained later.

Continuing to refer to FIG. 2, each opening or port has a back wall 32 extending transversely and generally perpendicular to the plug insertion axes B and D. Each of the walls includes a plurality of generally parallel and vertically extending grooves 34 that form a comb structure adjacent the bases 30*a*, 30*b*, respectively, of each opening. The grooves 34 receive the distal ends of mating portions of contact terminals as will be later described. The terminals are not illustrated in FIGS. 1 and 2 for purposes of drawing simplicity. The numerals 1, 2, 3, and 6 appearing on the back wall of each of the cavities in FIG. 2 denote the positions of the grooves that receive terminals utilized for signal transmission in each port for Ethernet applications. The eight port positions are numbered serially from left to right in the bottom port 24*a* and from right to left in upper ports 26*a*. Terminals used for other than signal transmission may be received in the numbered slots (positions 4, 5, 7 and 8), as will later be described.

As shown in FIGS. 1 and 2, each of the upper row openings, such as opening 26*a*, is laterally offset by an amount T from an adjacent opening 24*a* in the lower row. This lateral offset accommodates the use of a single array of contact terminals with a first group of terminals of the array disposed in the lower opening 24*a* and a second group of the terminals being disposed in the upper opening 26*a*. In certain arrangements later described, one or more of the terminals of the first group can be interleaved with contact terminals of the second group. If the openings are configured for RJ 45 series plugs wired for Ethernet applications, a preferable dimension for the offset T is about 0.08 inches, which is twice the center line distance between adjacent terminals in an eight position plug. While an offset of 0.08 inches yields adequate cross talk minimization (especially between the differential pairs utilizing port position 3 and port position 6 in adjacent ports) and is convenient from a manufacturing point of view because it is an even multiple of the center line distances between terminals, somewhat larger offsets may optimize cross talk reduction.

Figure 3:
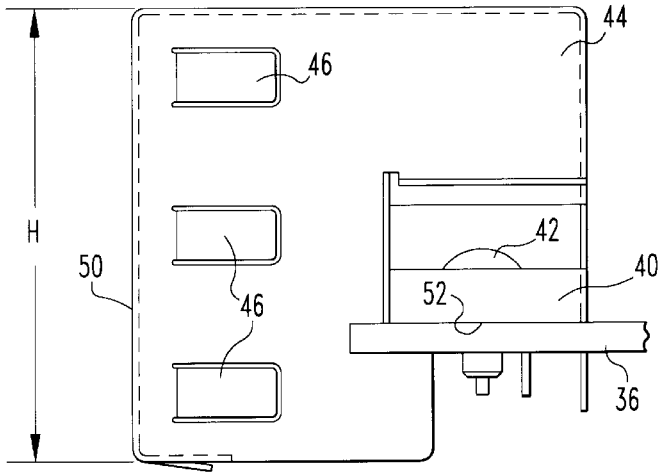
FIG. 3 is a side elevational view of the connector shown in FIG. 1.
Figure 4:
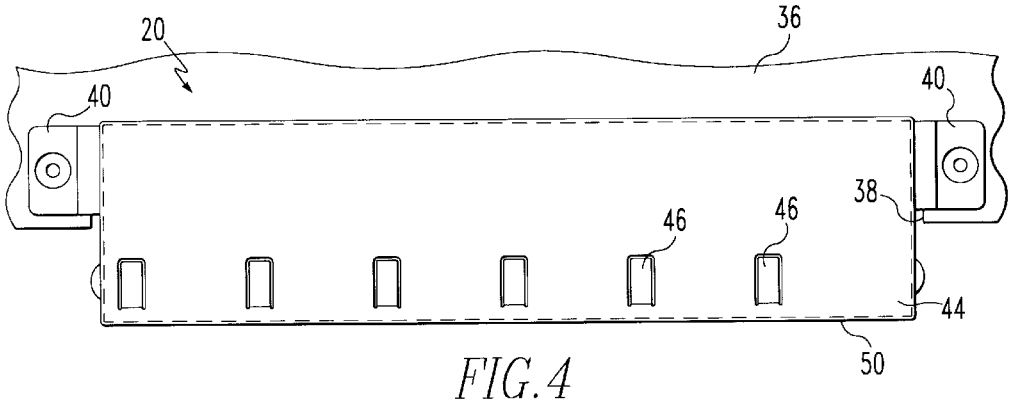
FIG. 4 is a top plan view of the connector shown in FIG. 1.

As shown in FIG. 3 and 4, the connector 20 is mounted along an edge of the circuit board 36 and is at least partially received within a rectangular cut out 38 dimensioned to receive a portion of the connector. The connector is supported on mounting lugs 40 and is secured to the circuit board or substrate 36 by the fasteners 42. The illustrated mounting arrangement shows only one of many ways by which the connector can be mounted on a circuit substrate.

As is conventional, the connector 20 can include a sheet metal shield 44 to provide EMI shielding. Spring fingers 46 may be formed in the shield for engaging the edges of an opening in an equipment panel (not shown) through which the mating face 50 of the connector extends. As is also conventional, the shield can include face tabs 48 (FIG. 2) that extend into the openings to aid in holding the front face of the shield on the connector body 22.

The underside 52 of the lugs 40 may define a mounting interface along which the connector is mounted to the circuit substrate 36.

Figure 5:
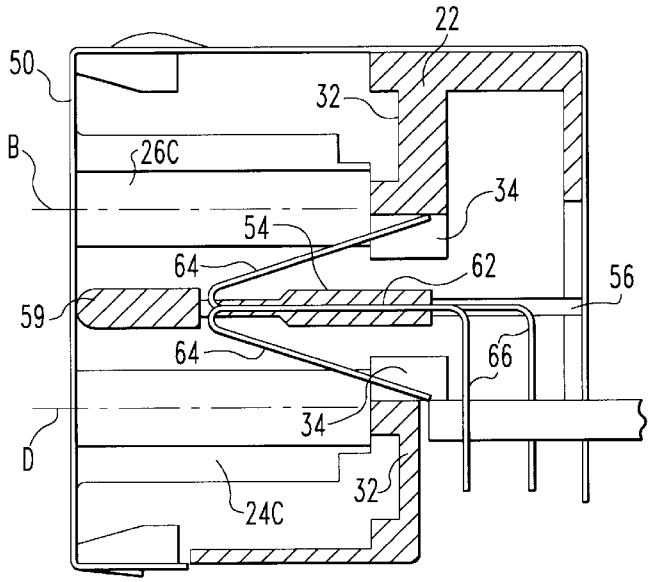
FIG. 5 is a side cross sectional view taken along line CC of FIG. 1.
Figure 6:
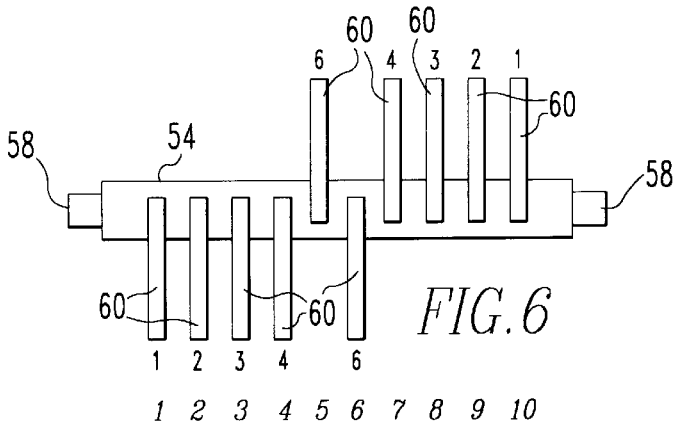
FIG. 6 is a front elevational view of a contact terminal assembly shown in FIG. 5.
Figure 12:
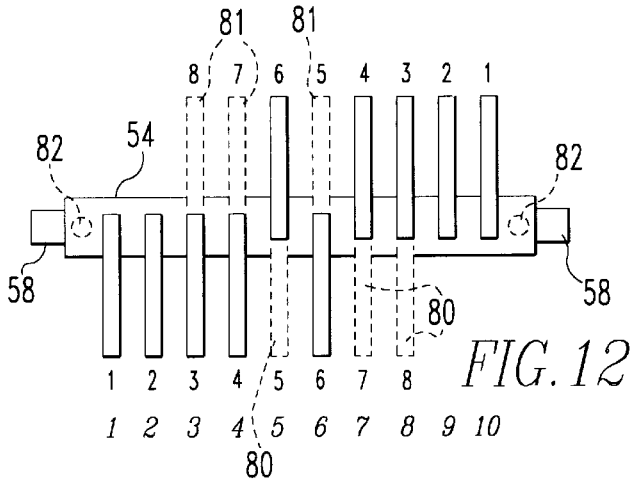
FIG. 12 is a front view of a contact terminal assembly showing the positions of signal terminals and commoned terminals.

In FIG. 5, a preferred arrangement for retaining contact terminals within the housing 22 is shown. In this arrangement, a linear array of contact terminals 60 (FIG. 6) is positioned generally centrally within the housing 22 in alignment with the web 59 formed between the lower opening 24*c* and the upper opening 26*c*. The terminals 60 are formed of stamped material or wire having a hardness sufficient to impart springiness to the material. As shown, the array includes ten terminals that are held in mutual spaced relation by a terminal retaining insert 54. In FIGS. 6 and 12, the numerals 1–10 in italics denote the positions of the terminals in each terminal retaining member 54. In FIG. 12, the rows of numerals adjacent the contact terminal 60 denote the terminal position within each opening. The member 54 may have the terminals inserted into it or may be insert molded about the terminals 60. The terminal retaining member 54 preferably includes an opposed pair of ribs 58 (FIG. 6) extending along opposed ends thereof. The ribs are designed to be slidingly received in a pair of opposed grooves, one of which grooves 56 is shown is FIG. 5. By reason of this arrangement, the insert 54 can be slid into position within the housing, with portions of the terminals extending into one or the other of the openings 24*c*, 26*c*.

Each of the terminals 60 (FIG. 6) includes a mid portion 62, that are maintained in substantially coplanar position by the insert member 54. Each contact terminal includes a mating portion 64, which in the illustrated embodiment comprises a bent, cantilevered portion extending from one end of each terminal mid portion 62. As shown, the portions 64 are formed by bending the distal portion of the contact to form the mating portion 64, the end of each one of which is retained within an appropriate groove 34 in the back wall 32. As is conventional, a desired amount of preload is placed on the mating portion 64 when they are placed within the grooves 34. As shown in FIG. 6, the mating portions 64 are bent either upwardly or downwardly so that they enter the openings 26*c* or 24*c* respectively. In the illustrated arrangement, a first group of contacts has the mating portion 64 bent downwardly to enter the opening 24*c*. This group comprises the terminal contacts at terminal retainer positions 1, 2, 3, 4 and 6. A second group of mating portions is bent upwardly and as illustrated comprises the terminals at terminal retainer positions 5, 7, 8, 9 and 10. For Ethernet usage, the terminals at terminal retainer positions 1, 2, 3, 6 and 5, 8, 9 and 10 are utilized for signal transmission. Terminals at retainer positions 4 and 7 may be for other purposes, such as power or ground. In the illustrated arrangement, the terminals of the two groups at retainer positions 4, 5, 6 and 7 are interleaved.

Figure 7:
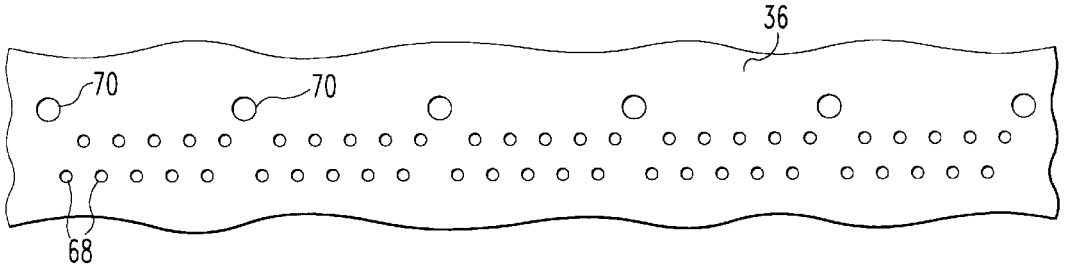
FIG. 7 is a fragmentary portion of a circuit board showing the location of a recommended layout for through holes to receive terminals of the connector shown in FIGS. 1–5.

As shown in FIG. 5, each of the terminals 60 has a tail section 66 extending from the other end of the mid portion 62. In the embodiment shown in FIG. 5, the tails 66 comprise through hole pins that are designed to be received in plated through holes 68 formed in the circuit substrate 36. Plated through holes 70 are arranged to receive pins from the shield 44. Referring to FIG. 7, the numerals adjacent through hole 68 show a preferred arrangement for receiving the through hole tails 66 of terminal contacts 60.

Figure 8:
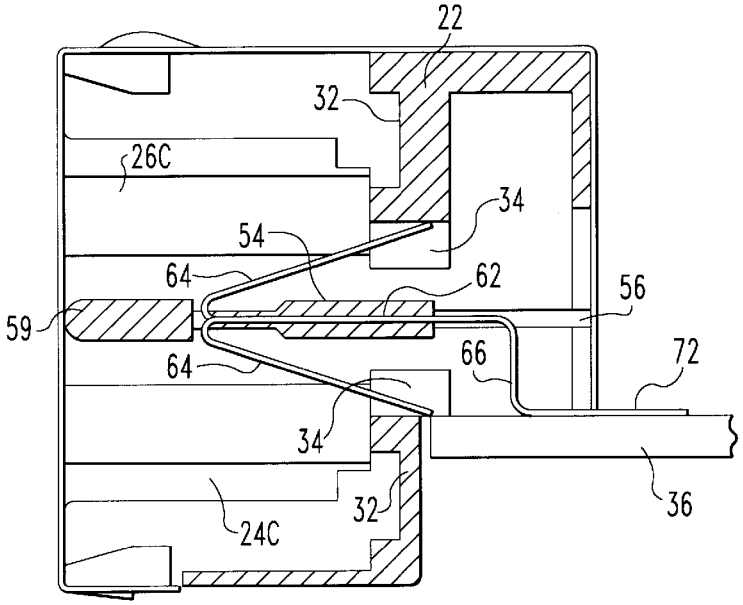
FIG. 8 is a side cross sectional view of a second embodiment similar to the embodiments of FIG. 5 but having contact terminals with surface mount tails.
Figure 9:
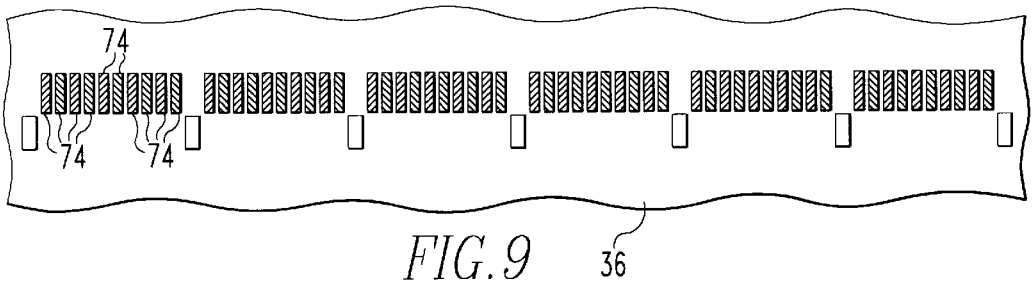
FIG. 9 is a recommended circuit board layout for use with the connector shown in FIG. 8.

Referring to FIG. 8, a surface mount embodiment of the connector 20 is illustrated. In this embodiment, the primary difference with the embodiment illustrated in FIG. 5 is that each contact tail 66 includes surface mount tabs 72 adapted to be surface mounted on surface mount contacts 74 (FIG. 9) of the circuit substrate 36. An important advantage of the arrangement shown in FIG. 8 is that the tails 66 and surface mount tabs 72 for both the lower opening 24*c* and the upper opening 26*c* can be arranged in a single line, as only ten tabs 72 need to be accommodated in the area behind each pair of upper and lower ports. This latter feature arises from the fact that the contact terminals for the upper and lower decks are at least partially interleaved and, for Ethernet purposes, certain of the unused terminals of the conventional RJ45 eight terminal array can be eliminated. The single line arrangement of surface mount tails results in a reduction in the amount of space on the circuit substrate 36 necessary to accommodate the surface mounting tabs 72.

Figure 10:
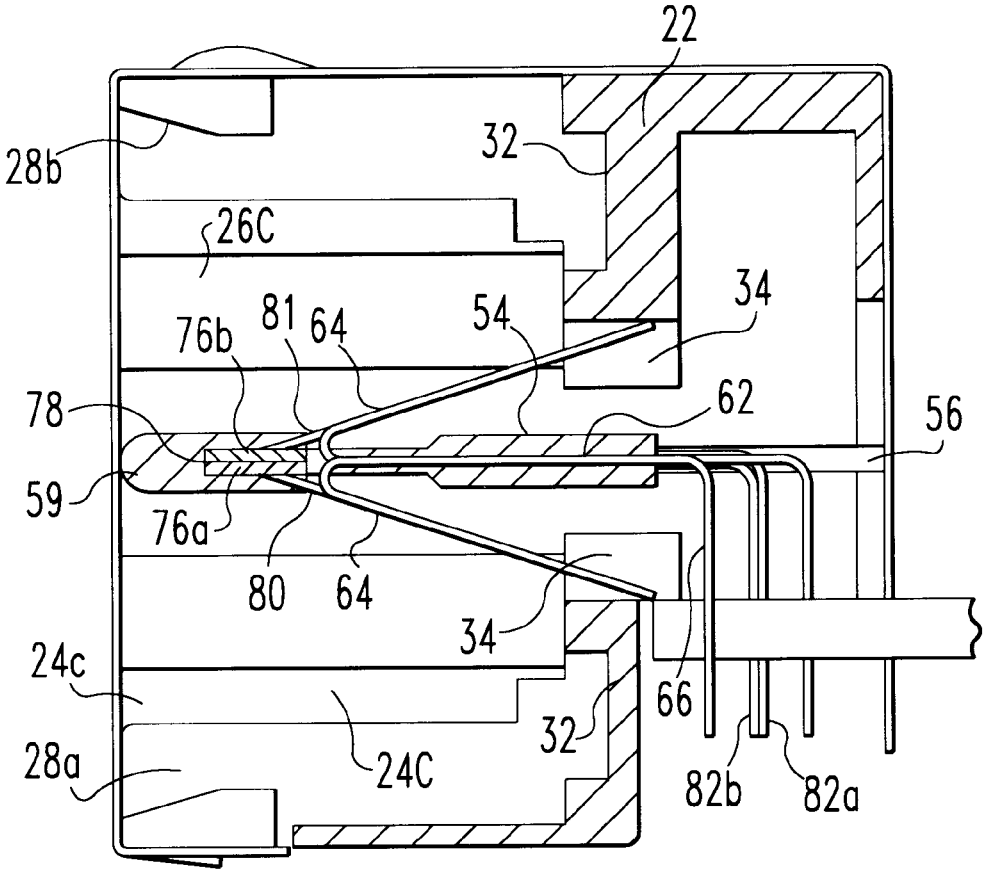
FIG. 10 is a side cross sectional view similar to FIG. 5 showing the incorporation of a commoning arrangement for certain contact terminals.
Figure 11A:
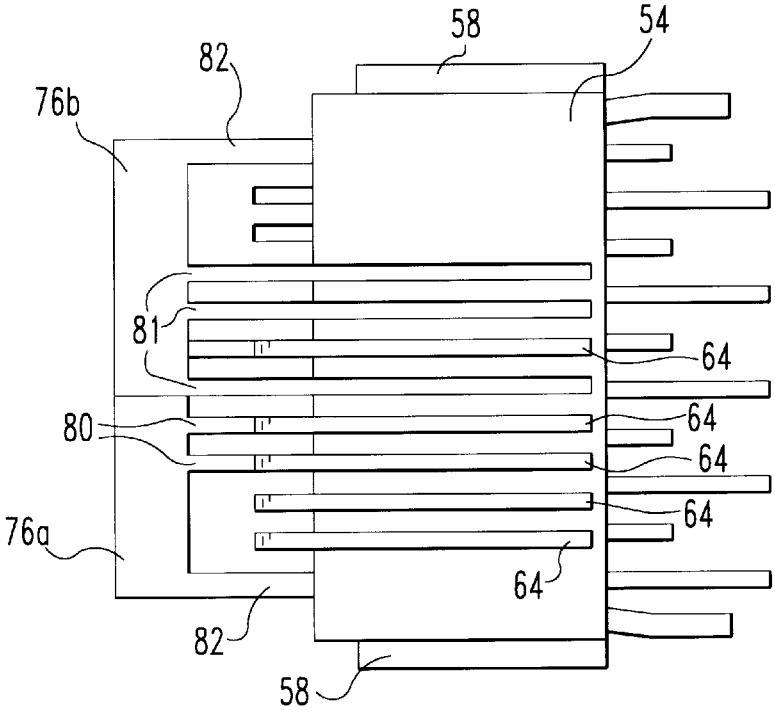
FIG. 11*a* is a top view of a terminal carrier with signal and commoned ground terminals.
Figure 11B:
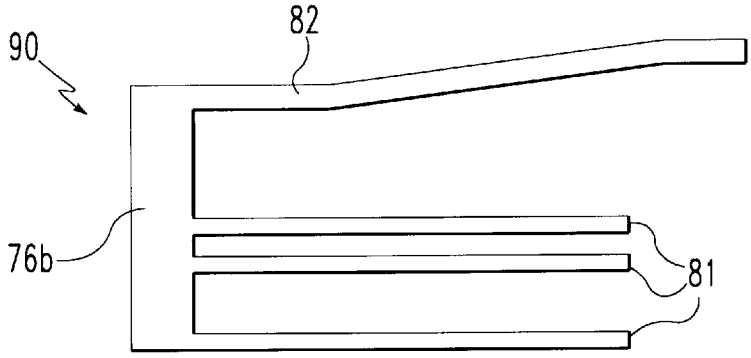
FIG. 11*b* is a top view of a blank having a set of commoned ground terminals.

In certain applications, it may be advantageous to provide ground contact terminals that are commoned in order to achieve improved EMI or cross talk performance. The commoned terminals may be located in port positions not utilized for signal transmission and for which there is no corresponding contact among the ten contact terminals 60 secured in the retaining member 54. FIGS. 10 and 11*a* illustrate one embodiment for satisfying this requirement. In this arrangement, bus strips 76*a* and 76*b* carry one or more terminals 80, 81 that are to be received in the lower or upper ports or openings respectively. These terminals 80, 81 are bent with respect to the bus strips 76*a*, 76*b* upwardly or downwardly as shown by terminals 80 and 81 in FIG. 10. The commoned terminals can be formed from a flat blank 90 (FIG. 11*b*), which includes terminal tail 82 for connecting the commoned terminals to the circuit substrate through an additional plated through hole. As shown in FIG. 11*b*, the stamped member 90 comprises the bus strip 76*b* and terminals 81. The tails 82 are retained in the retaining member 54 (FIG. 11*a*). To form commoned terminals 80 for the lower opening, another stamping 90 is inverted and placed immediately below and offset with respect to the top stamping (See FIGS. 10 and 11). The overlapping portions of bus strips 76*a*, 76*b* may be joined together, as by welding or soldering. As the retaining member is inserted into the housing along grooves 56, the bus strips 76*a*, 76*b* are received in a groove 78 formed in a rear surface of the web 59. In Ethernet applications, the three non-signal terminal positions 5, 7 and 8 in each of the ports can be commoned and used for other purposes such as power or grounding, by use of the stampings 90. In this case, the contact terminals at port positions 4 in each pair of stacked ports (i.e., positions 4 and 7 of the ten terminal array associated with each terminal retaining member 54) comprise individual terminals formed in the manner previously described, that can also be used for other purposes, including as power or ground contacts. As an alternative to the configuration shown in FIG. 6, the terminals at locations 4 and 7 of the array can be bent in the same direction, so that they are both in either an upper or lower port. With this configuration, the 4, 7 pair can provide additional functionality, for example, they can be used for telephone communication. FIG. 12 shows a contact terminal insert 54 for use in Ethernet applications having commoned terminals. The commoned terminals 80 for the lower opening are shown in phantom at lower port positions 5, 7 and 8. The commoned ground terminals 81 for the upper openings are shown in phantom at upper port positions 5, 7 and 8. The position of tails 82 is shown in phantom. Alternatively, terminals at retainer positions 4 and 7 (i.e., upper and lower port positions 4) could also be incorporated into the stampings 90, for commoning with the other non-signal terminals.

Figure 13:
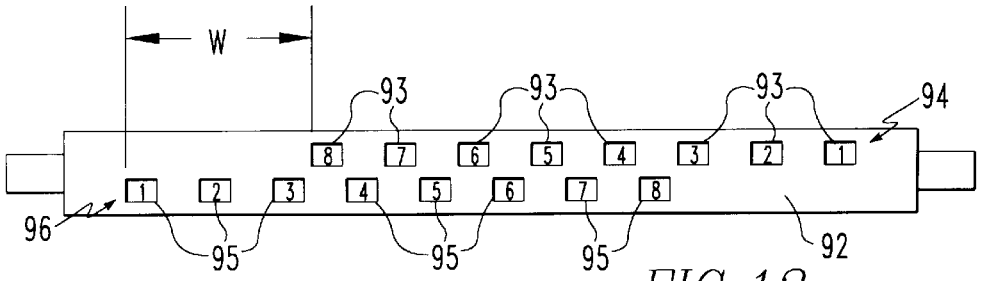
FIG. 13 shows another form of terminal arrangement embodying the invention.

FIG. 13 illustrates the cross section of another arrangement of contact terminals secured within an insulative contact retaining member 92. In this embodiment, two rows 94, 96 of contact terminals are secured on the retaining member 92. The mid portions 93 of the upper row 94 are preferably substantially coplanar, as are the mid portions 95 of the terminals in the bottom row 96. The upper coplanar array of terminals 93 forming row 94 is laterally offset by an amount W from the coplanar array of terminals 95 forming row 96. The offset W provides separation between terminals of each row that can be optimized to improve near end cross talk performance. The amount of offset W needed to optimize cross talk performance would be dependent upon pair assignments within the jacks and mating plugs. The offset allows the rows 94 and 96 to be placed close together and may eliminate the need for a shield between the rows, thereby minimizing the height of retaining member 92. As a consequence, member 92 having a reduced height can be located between stacked offset ports and the overall height of the housing can be minimized, as in the previously described embodiments.

Figure 14:
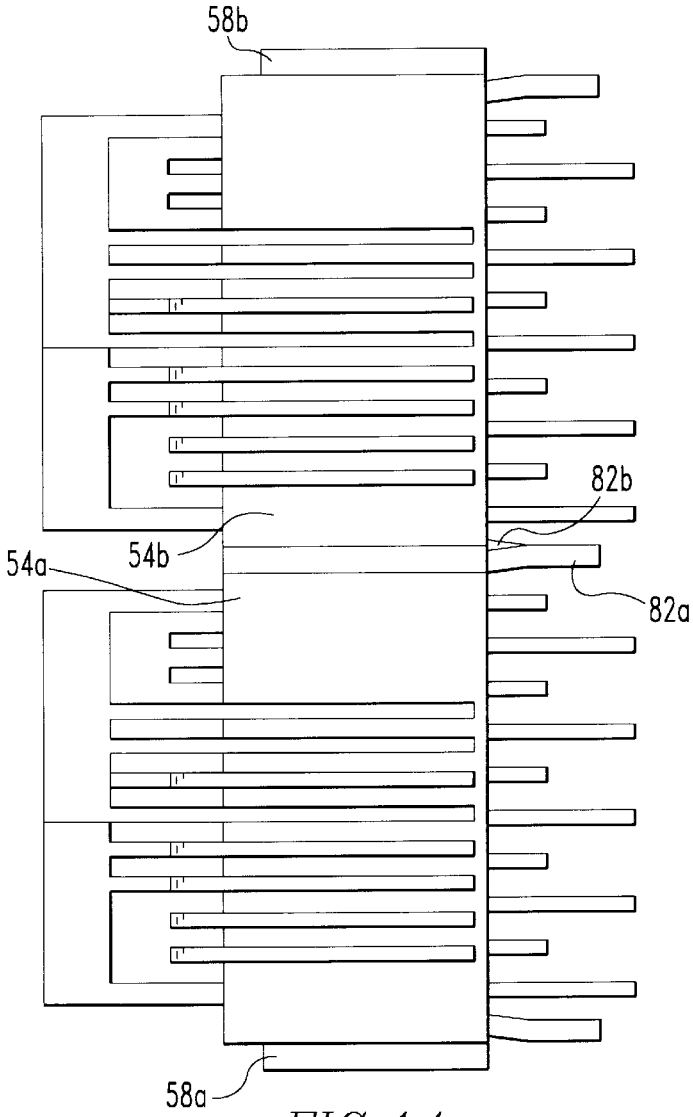
FIG. 14 is a top view of two adjacent terminal retaining members with terminal commoning features.
Figure 15:
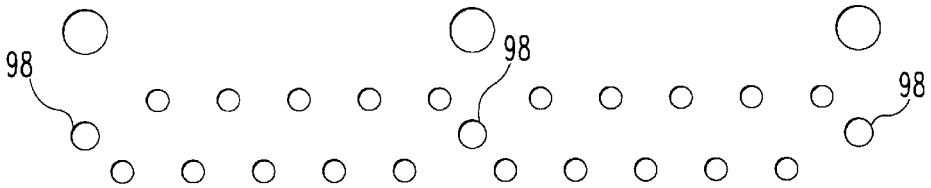
FIG. 15 illustrates a hole pattern in a circuit substrate for receiving terminal tails from the arrangement shown in FIG. 14.

Referring to FIG. 14, a preferred way of routing the tails 82 is to have the tail 82*a* along an edge of one of the retaining members 54*a* substantially overlapping the tail 82*b* of the next adjacent retaining member 54*b* (see also FIG. 10) in the region where the tails are bent downwardly toward the mounting interface of the connector. The distal portions of tails 82*a*, 82*b* can be placed into a common through hole, such as the holes 98 shown in the through hole layout of FIG. 15. To aid in this placement of the tails, the ribs 58*a* and 58*b* are offset vertically, so that the ribs of adjacent terminal retaining members 54*a*, 54*b* can overlap, thereby allowing the terminal retaining members to be placed closely adjacent each other in side by side relationship. This allows the tails 82*a*, 82*b* to be placed more easily in overlapping relationship. Of course, to accommodate this construction, the grooves 56 associated with each stacked pair of ports also must be offset in the direction of the height of the stack.

From the foregoing description, several advantages are forthcoming. The height of the housing can be minimized to dimensions well below one inch by utilizing a single contact array and by the elimination of metal shields between the stacked openings. The reduction in housing height is accomplished while maintaining cross talk performance at Category 5 levels. Typically, near end cross talk isolation exceeding −40 dB between the stacked jacks can be achieved in arrangements embodying the invention.

Further, by the use of a single contact array containing the contacts for both stacked jacks, and by eliminating unnecessary contact terminals and interleaving remaining terminals, single line contact tail arrangements can be achieved. This results in a reduction of circuit board space utilized by the connector. Further, the use of a single contact array and retainer lessens the number of parts, simplifies assembly and results in reduced manufacturing costs.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector comprising:

a housing having a first opening for receiving a mating connector along a first insertion axis and a second opening for receiving a mating connector along a second insertion axis, the first opening being adjacent the second opening, with the second insertion axis being laterally offset with respect to the first insertion axis, and an array of contact terminals in the housing, the array having a first group of contact terminals associated with the first opening and a second group of contact terminals associated with the second opening, the contact terminals in generally side by side relationship and at least one contact terminal of the first group being mutually interleaved with at least one contact terminal of the second group, a mating portion of at least one of the first group of contact terminals extending into the first opening for mating with a connector received in the first opening and a mating portion of at least one of the second group of contact terminals extending into the second opening.

2. A connector as in claim 1, wherein the first and second insertion axes are substantially parallel.

3. A connector as in claim 1, wherein the contact terminals are mounted on an insert formed of an insulative material and the insert is mounted in the housing between the first and second openings.

4. A connector as in claim 1, wherein the contact terminals have circuit substrate engaging tails and the tails are arranged in a single line.

5. The electrical connector as recited in claim 1, wherein said second insertion axis is laterally offset from said first insertion axis a distance of at least approximately twice a centerline distance between adjacent contact terminals.

6. The electrical connector as recited in claim 1, wherein said offset distance is at least approximately 0.08".

7. The electrical connector as recited in claim 1, wherein said first opening has an orientation and said second opening has an orientation opposite said orientation of said first opening.

8. The electrical connector as recited in claim 1, wherein said array of contact terminals have portions that are generally coplanar.

9. A connector as in claim 1, wherein each of the contact terminals includes a tail portion for engaging a circuit substrate on which the connector is mounted, all of the tail portions being arranged in a single line.

10. A connector as in claim 1, wherein the at least one interleaved contact terminal of the first group is next adjacent to the at least one interleaved contact terminal of the second group.

11. An electrical connector as in claim 10, wherein the contact terminals are disposed in a linear array of ten terminals with terminals at positions 1, 2, 3, and 6 forming the first group and the terminals at positions 5, 8, 9 and 10 forming the second group.

12. A connector as in claim 11, wherein the contact terminals have mid portions and said mid portions are substantially coplanar.

13. An electrical connector as in claim 11, wherein a terminal at position 4 is in the first group and a terminal at position 7 is in the second group.

14. A connector as in claim 13, wherein the contact terminals have circuit substrate engaging tails arranged in a single line.

15. A connector as in claim 14, wherein the tails each include a surface mount portion for engaging the circuit substrate.

16. A connector as in claim 1, wherein the first and the second openings comprise RJ series receptacles.

17. A connector as in claim 16, wherein the first and second openings are in stacked relationship and a height of the housing is less than about 0.90 inches.

18. A connector as in claim 17, wherein the height of the housing is about 0.87 inches.

19. A connector as in claim 1, wherein the housing includes a plurality of first openings aligned in a first row and a plurality of second openings aligned in a second row, the first row and the second row being in stacked relation.

20. A connector as in claim 19, wherein the openings in the first row are laterally offset from the openings in the second row.

21. A connector as in claim 19, wherein each opening has a base and the bases of the openings forming the first row are disposed adjacent the bases of the openings in the second row.

22. A connector as in claim 21, wherein the first group of contact terminals extend into the first openings and the second group of contact terminals extend into the openings.

23. A connector as in claim 22, and further comprising a contact terminal retaining member, each array of contact terminals being carried by said retaining member, said housing including structure for receiving said retaining member in the housing.

24. An electrical connector as in claim 23, wherein the retaining member is slidably insertable within the housing.

25. An electrical connector as in claim 24, wherein the retaining member comprises a plurality of members, each member retaining one of said contact terminal arrays.

26. The connector as recited in claim 1, wherein said contact terminals in said first opening are positioned relative to said contact terminals in said second opening so as to produce an acceptable level of cross-talk therebetween.

27. The connector as recited in claim 26, wherein said acceptable level of cross-talk is approximately −40 dB.

28. An electrical connector comprising a housing;

a first opening in the housing for receiving a mating connector along an insertion axis;

a second opening in the housing in stacked relationship with respect to the first opening, for receiving a mating connector along an insertion axis;

an array of interleaved contact terminals disposed in a common insert in the housing between the first and second openings, each of the contact terminals having a mating portion for mating with a contact of the mating connectors insertable in either the first and second openings, the mating portions of a first group of the contact terminals being disposed in the first opening and the mating portions of a second group of the contact terminals being disposed in the second opening.

29. A connector as in claim 28, wherein each contact terminal comprises an intermediate portion and the mating portion comprises a distal portion forming a cantilevered section extending from the intermediate portion.

30. A connector as in claim 28, wherein the insertion axis of the first opening is laterally offset from the insertion axis of the second opening.

31. A connector as in claim 28, wherein each of the contact terminals includes a circuit substrate engaging tail and the tails are arranged in a single line.

32. The electrical connector as recited in claim 28, further comprising a plurality of electrically common contact terminals, at least one of said electrically common contact terminals associated with said first opening and another one of said electrically common contact terminals associated with said second opening.

33. A connector as in claim 28, wherein the housing includes structure for retaining the insert in the housing.

34. A connector as in claim 33, wherein the structure locates the insert between the first and second openings.

35. A connector as in claim 34, wherein the structure slidably receives the insert.

36. A connector as in claim 28, wherein the openings comprise RJ series receptacles having their insertion axes disposed in substantially parallel relationship, and wherein a height of the housing is less than about 0.9 inches.

37. A connector as in claim 36, wherein the height of the housing is about 0.87 inches.

38. A connector as in claim 28, wherein the array of contact terminals comprises ten terminals, a first, second, third and sixth terminals of the array comprising the first group, and a fifth, eighth, ninth and tenth terminals of the array forming the second group.

39. A connector as in claim 38, wherein a fourth terminal of the array is in the first group and a seventh terminal of the array is in the second group.

40. The electrical connector as recited in claim 28, wherein said terminals include a first group of terminals and a second group of terminals parallel to said first group of terminals.

41. The electrical connector as recited in claim 40, wherein said first group of terminals are coplanar with said second group of terminals.

42. The connector as recited in claim 28, wherein said first group of contacts are positioned relative to said second group of contacts so as to produce an acceptable level of cross-talk therebetween.

43. The connector as recited in claim 42, wherein said acceptable level of cross-talk is approximately −40 dB.

44. An electrical connector comprising:

a housing having a first opening for receiving a mating connector along a first insertion axis and a second opening for receiving a mating connector along a second insertion axis, the second opening being in stacked relation to the first opening;

a plurality of electrically uncommon contact terminals retained in the housing, each contact terminal having a mating portion, a tail portion for engaging a circuit substrate on which the connector is mounted and an intermediate portion, the intermediate portions of the plurality of contact terminals being arranged in a substantially coplanar array disposed between the first and second openings; and the contact terminals comprising a first group and a second group, the mating portions of the first group of contacts being disposed in the first opening and the mating portions of the second group of contacts being disposed in the second opening.

45. A connector as in claim 44, wherein the tail portions of said plurality of contact terminals being disposed in a single line.

46. A connector as in claim 44, wherein each mating portion comprises a cantilevered section extending into an associated opening.

47. A connector as in claim 44, and further comprising a terminal retaining member for retaining the terminals, and a securing member for securing the retaining member in the housing.

48. A connector as in claim 47, wherein the intermediate portions of the contact terminals are secured in the terminal retaining member.

49. A connector as in claim 44, wherein at least one of the first group of contact terminals is interleaved with at least one of the second group of contact terminals.

50. A connector as in claim 49, wherein the first opening is laterally offset from the second opening.

51. A connector as in claim 44, wherein a base of the first opening is disposed adjacent a base of the second opening.

52. A connector as in claim 51, wherein the first opening is laterally offset with respect to the second opening.

53. A connector as recited in claim 44, wherein the housing has a height of less than about 0.9 inch.

54. A connector as in claim 53, wherein the height of the housing is about 0.87 inches.

55. A connector as in claim 47 and further comprising a plurality of electrically commoned contact terminals.

56. A connector as in claim 55, wherein the commoned contact terminals are carried by the contact terminal retaining member.

57. The connector as recited in claim 44, wherein said first group of contacts are positioned relative to said second group of contacts so as to produce an acceptable level of cross-talk therebetween.

58. The connector as recited in claim 57, wherein said acceptable level of cross-talk is approximately −40 dB.

59. An electrical connector, comprising:

a housing having a first opening for receiving a mating connector along a first insertion axis and a second opening for receiving a mating connector along a second insertion axis, the second opening being in stacked relation to the first opening;

a plurality of contact terminals retained in the housing, each contact terminal having a mating portion, a tail portion for engaging a circuit substrate on which the connector is mounted and an intermediate portion, the intermediate portions of the plurality of contact terminals being arranged in a substantially coplanar array disposed between the first and second openings; and the contact terminals comprising a first group and a second group, the mating portions of the first group of contacts being disposed in the first opening and the mating portions of the second group of contacts being disposed in the second opening, wherein at least one of the first group of contact terminals is interleaved with at least one of the second group of contact terminals.

60. The electrical connector as recited in claim 59, wherein said first opening is laterally offset from said second opening.

61. The connector as recited in claim 59, wherein said housing has a height of less than about 0.9 inch.

62. The connector as recited in claim 61, wherein said height of said housing is approximately 0.87 inch.

* * * * *